US006286213B1

(12) United States Patent
Hada et al.

(10) Patent No.: US 6,286,213 B1
(45) Date of Patent: Sep. 11, 2001

(54) METHOD OF SECURING INTAKE TUBES IN INTAKE MANIFOLD

(75) Inventors: Masatoshi Hada, Nagoya; Yasuo Sunaga, Koga, both of (JP)

(73) Assignees: Aichi Kikai Kogyo Kabushiki Kaisha, Nagoya; Sanoh Kogyo Kabushiki Kaisha, Koga, both of (JP)

( * ) Notice: Subject to any disclaimer, the term of this patent is extended or adjusted under 35 U.S.C. 154(b) by 0 days.

(21) Appl. No.: 09/482,324

(22) Filed: Jan. 14, 2000

(30) Foreign Application Priority Data

Jan. 27, 1999 (JP) ..... 11-019066

(51) Int. Cl.[7] ..... B21D 39/08

(52) U.S. Cl. ..... 29/890.044; 29/890.052; 29/507; 29/523

(58) Field of Search ..... 29/890.052, 890.044, 29/890.043, 727, 507, 523, 282, 283.5, DIG. 4; 228/165, 168, 174, 256; 285/382.4, 382.2, 382.5, 222

(56) References Cited

U.S. PATENT DOCUMENTS

| | | | | |
|---|---|---|---|---|
| 4,663,119 | * | 5/1987 | Kerrey | 29/723 |
| 4,713,870 | * | 12/1987 | Szalvay | 29/507 |
| 5,127,157 | * | 7/1992 | Oetiker | 29/507 |
| 5,253,616 | | 10/1993 | Voss . | |
| 5,400,951 | | 3/1995 | Shiroyama et al. . | |
| 5,626,808 | * | 5/1997 | Miyajima | 29/523 |
| 5,667,252 | * | 9/1997 | Schafer et al. | 29/507 |
| 5,713,611 | * | 2/1998 | Kurimoto et al. | 29/890.044 |
| 5,848,469 | * | 12/1998 | O'connor et al. | 29/523 |
| 6,131,265 | * | 10/2000 | Bird | 29/523 |

FOREIGN PATENT DOCUMENTS

| | | |
|---|---|---|
| 3724675 | 2/1989 | (DE) . |
| 97/41377 | 11/1997 | (WO) . |

* cited by examiner

*Primary Examiner*—I Cuda-Rosenbaum
*Assistant Examiner*—Trinh Nguyen
(74) *Attorney, Agent, or Firm*—Dennison, Scheiner, Schultz & Wakeman

(57) ABSTRACT

A method of securing intake tubes in an intake manifold is provided in which leakage of brazing material from the joint between the intake tubes and the intake tube mounting rings is prevented. For securing each intake tube in the intake manifold, the intake tube 3 is fitted into the intake tube mounting ring 5. Then, a jig 13 of a tubular shape is inserted into insert areas of the intake tube 3 and the intake tube mounting ring 5. The jig 13 includes separate sections 16 defined by slits extending to a predetermined length in parallel to the axis and has a plurality of projections 19 and 20 provided on the outer side of the separate sections 16 thereof. A bar-like pressing tool 14 reduced in the diameter towards its front end is inserted into the interior of a tubular shape of the peen locking jig 13, and it is then advanced relatively towards the insert area by the action of pressing means. As a result, the projections 19 and 20 are dislocated radially and press the outer side of the intake tube 3 against the inner side of the intake tube mounting ring 5 to join each other by the effect of plastic deformation.

2 Claims, 4 Drawing Sheets

METHOD OF SECURING INTAKE TUBES IN INTAKE MANIFOLD

BACKGROUND OF THE INVENTION

1. Field of the Invention

The present invention relates to an intake manifold for an engine and particularly, a method of securing intake tubes in an intake manifold.

2. Description of the Related Art

Intake manifolds for combining intake tubes to a multi-cylinder engine to groups or a single bundle are arranged to prevent interference between the intake tubes and to provide uniform distribution of intake air.

A known intake manifold 1 includes, as shown in FIG. 8, a collector 2 formed of aluminum die-casting, a plurality of intake tubes 3 made of aluminum pipe, and an intake tube mount 4 formed of aluminum die-casting for fixedly mounting the intake tubes 3 to the engine. The intake tubes 3 are inserted into intake tube mounting rings 5 formed on the collector 2 and the intake tube mount 4 as shown in FIG. 9 and fixedly joined to the intake tube mounting rings 5 by point welding such as spot welding at points A or A' on the periphery shown in FIG. 9.

In such a conventional method of securing the intake tubes 3 to the intake tube mounting rings 5, brazing in a furnace for jointing the intake tube mount 4 with the intake tube mounting rings 5 may produce a leakage of brazing material from the points A of spot welding between the intake tubes 3 and the intake tube mounting rings 5. Accordingly, an extra amendment for the brazing is needed and the leakage of brazing material runs out to a portion B of the intake tube mounting ring 5, thus resulting in loss of the brazing material. This may cause a sealing failure when the intake manifold 1 is installed in the engine. Also, the point welding such as spot welding may be likely to have the intake tubes 3 joined to the intake tube mounting rings 5 in tilted state as denoted by 3' in FIG. 9.

SUMMARY OF THE INVENTION

The present invention is intended to eliminate the foregoing problems and its object is to provide a method of securing the intake tubes in an intake manifold with producing no leakage of brazing material from joint interface between the intake tubes and the intake tube mounting rings.

For eliminating the foregoing problems of the prior art, a method of securing intake tubes in an intake manifold according to the present invention is provided comprising the steps of: inserting one end of an intake tube into a corresponding intake tube mounting ring; inserting into insert areas of the intake tube mounting ring and the intake tube a jig of a tubular shape which includes separate sections defined by parallel slits extending to a predetermined length along the axis and has a plurality of projections on the outer side of the separate sections thereof; inserting into the interior of a tubular body of the jig a pressing tool which is a bar reduced in the diameter towards its front end; and driving the pressing tool to advance relative to the insert areas using a pressing means so that the projections of the jig move radially and causes the outer side of the intake tube to press against the inner side of the intake tube mounting ring, whereby the intake tube can be joined to the intake tube mounting ring by its plastic deformation.

Accordingly, while leakage of the brazing material can be prevented by some of the projections, the joint between the intake tubes and the intake tube mounting rings can be ensured by the other of the projections.

It may be arranged that the projections of the jig comprise spot projections and an annular projection and the spot projections are used for joining the intake tube to the intake tube mounting ring while the annular projection is used for the plastic deformation to prevent leakage of brazing material. In this case, the jig has a plurality of (for example, three) spot projections and an annular projection spaced from the spot projections which act in combination to prevent the intake tubes from being joined at tilted state to the intake tube mounting rings.

Therefore, the intake tubes can be reliably prevented from being joined at tilted state to the intake tube mounting rings.

DETAILED DESCRIPTION OF THE PREFERRED EMBODIMENT

Figure 8:
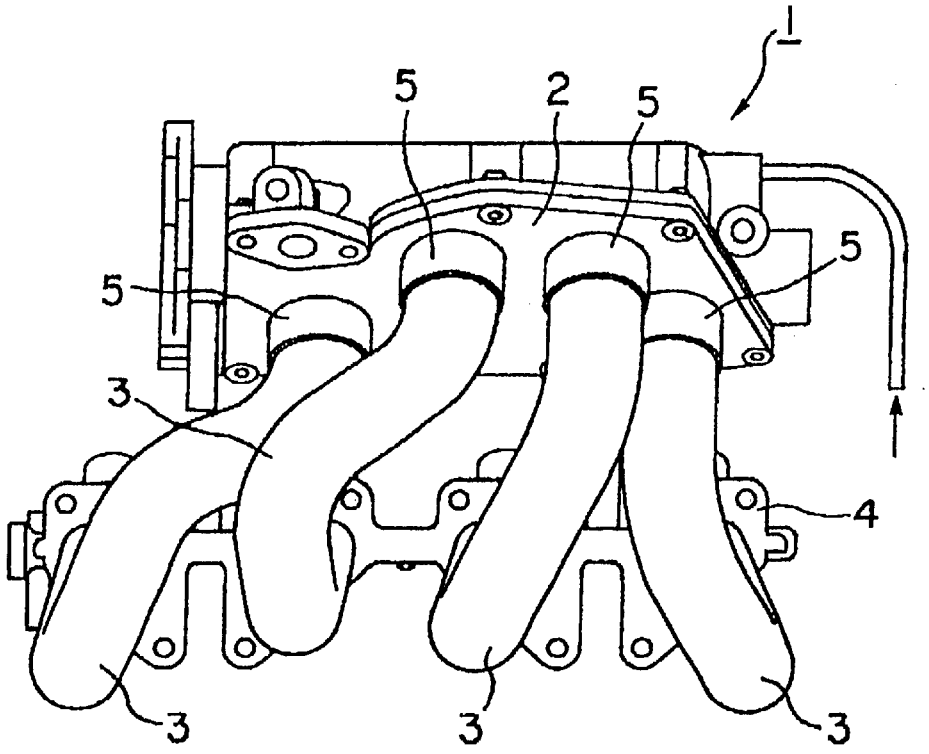
Fig 8 PRIOR ART
FIG. 8 is a plan view of an intake manifold.
Figure 9:
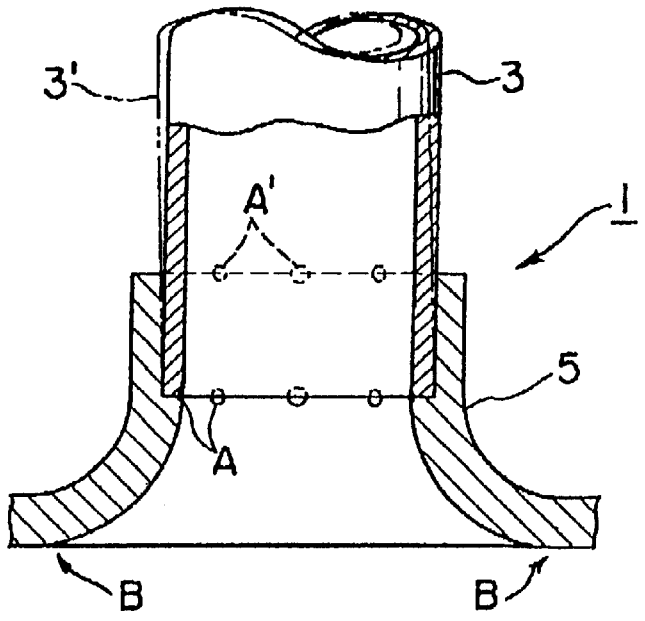
Fig 9 PRIOR ART
FIG. 9 is a cross sectional view showing joining between an intake tube and an intake tube mounting ring in a conventional manner.

An embodiment of the present invention will be described in connection with a method of securing intake tubes in an intake manifold 1 with reference to FIGS. 1 to 7. The intake manifold 1 of this embodiment is identical in construction to that of the prior art shown in FIG. 8 and will not be explained in detail.

Figure 1:
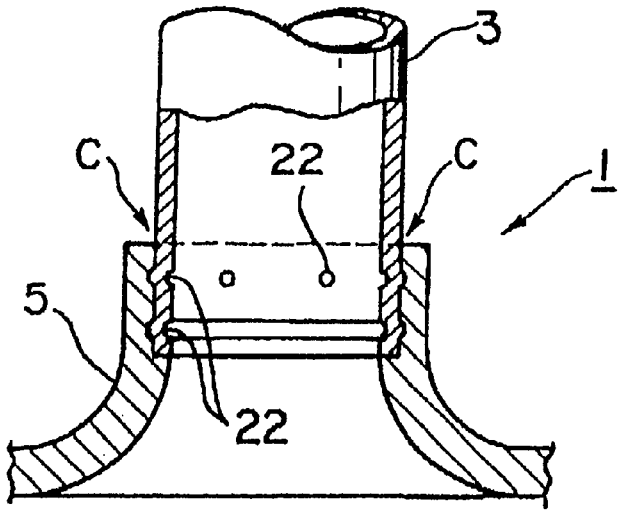
FIG. 1 is a cross sectional view showing joining between an intake tube and an intake tube mounting ring.
Figure 2:
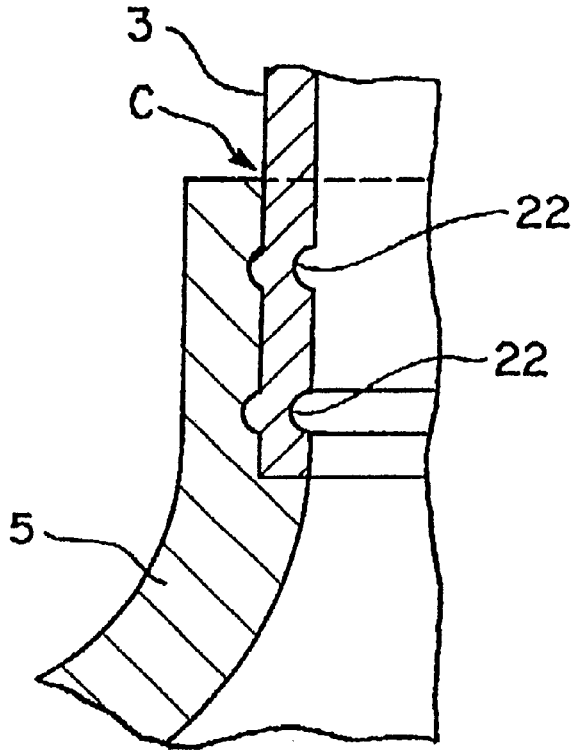
FIG. 2 is a partially enlarged cross sectional view of FIG. 1.

As shown in FIGS. 1 and 2, the intake tubes denoted at 3 are inserted into corresponding intake tube mounting rings 5 and fixedly joined to the same by brazing at points aligned along the outer side of each intake tubes 3 to the inner side of the corresponding intake tube mounting ring 5. Prior to the brazing, the intake tube 3 has to be secured to its corresponding intake tube mounting ring 5. The securing process is commonly carried out using a peen locking jig 13 shown in FIGS. 5 and 6 and a pressing tool 14 shown in FIG. 7.

The jig 13 has a tubular shape having a plurality of slits 15 (three in this embodiment) provided therein at equal intervals of an angle along the circumference and extending in parallel to the axis up to about ½ of its length. More specifically, the jig 13 comprises three separated sections 16. The inner side of a tubular body of the jig 13 is tapered as reduced in the inner diameter towards the open end 17 of the slits 15. The jig 13 has two rows of projection 18 provided on the outer side of each section 16 thereof which are spaced from each other along a circumferential direction orthogonal to the axis. One of the two rows 18 closed to the open end 17 of the slit 15 is a series of raised-shaped spot projections 19 aligned at equal intervals (six in this embodiment). The other row 18 far from the open end 17 is an annular projection 20 extending throughout the circumference.

The pressing tool 14 is a bar having a diameter at the front end 21 that is slightly smaller than the inner diameter at the open end 17 of the slits 15 of the jig 13. The diameter of the pressing tool 14 increases towards the rear end. The rear end of the pressing tool 14 is adapted for joining to pressing means such as a hydraulic cylinder.

The method of securing the intake tubes 3 is now explained.

Figure 3:
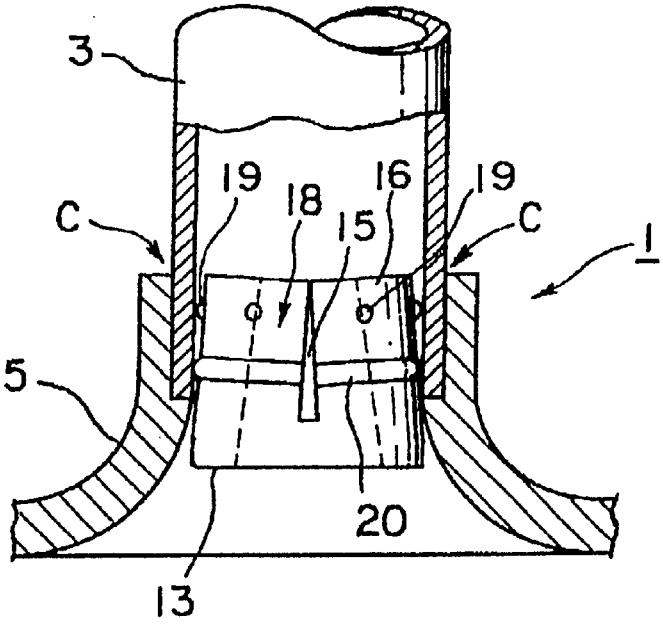
FIG. 3 is a cross sectional view showing a jig inserted into an insert area of the intake tube in the intake tube mounting ring.
Figure 4:
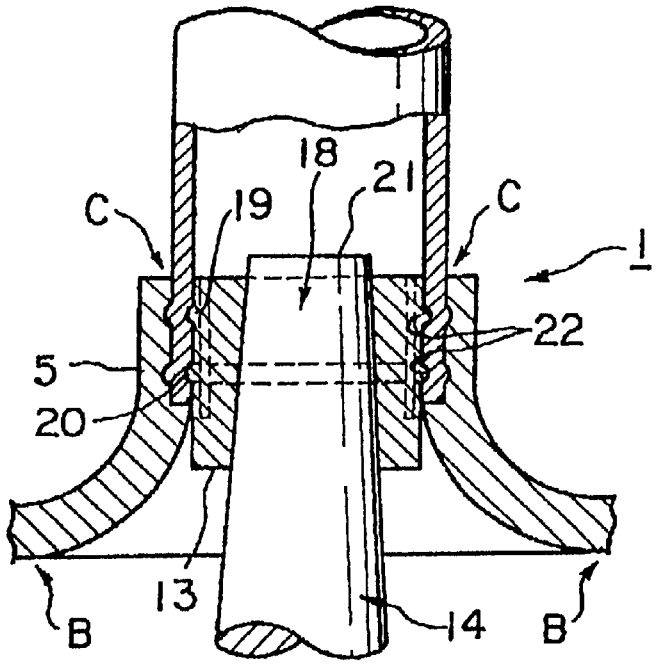
FIG. 4 is a cross sectional view showing a pressing tool inserted at the condition shown in FIG. 3.
Figure 5:
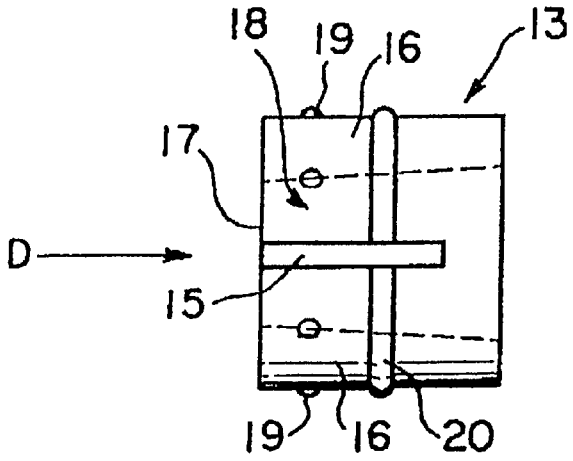
FIG. 5 is a plan view of the jig.
Figure 6:
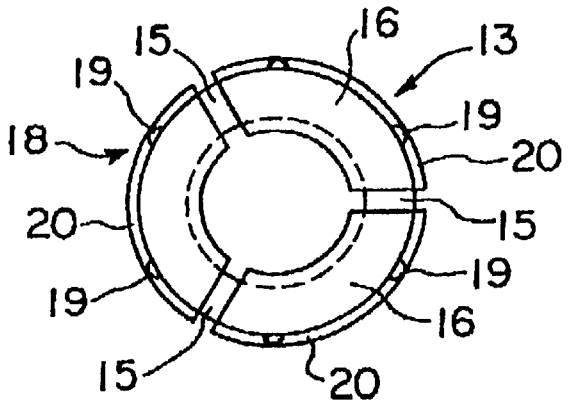
FIG. 6 is a cross sectional view seen from D.
Figure 7:
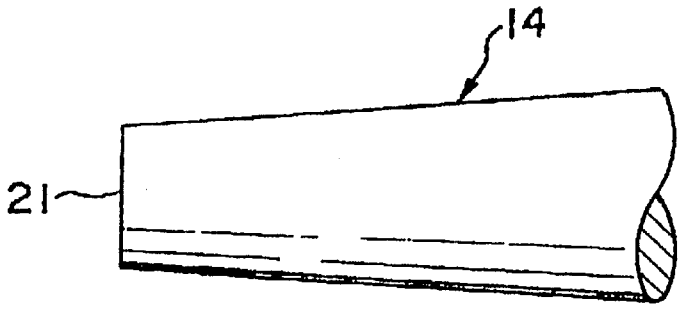
FIG. 7 is a plan view of the pressing tool.

First, the intake tube 3 is fitted into the intake tube mounting ring 5 from above as shown in FIG. 3. Then, the jig 13 is inserted from below into the intake tube mounting ring 5 with its slits 15 moving into the interior of the intake tube 3 fitted into the intake tube mounting ring 5. The pressing tool 14 is inserted from below into the jig 13 with its front end 21 engaging the jig 13 as shown in FIG. 4. The pressing tool 14 is then advanced relatively towards the jig 13 by the action of a hydraulic cylinder not shown. As a result, the spot projections 19 and the annular projection 20 are dislocated radially to press the inner side of the intake tube 3 and develop recesses 22 in the same due to plastic deformation. This causes the outer side of the intake tube 3 to press against the inner side of the intake tube mounting ring 5, resulting in the joining the intake tube 3 to the intake tube mounting ring 5 (See FIGS. 1 and 2). At the time, the spot projections 19 prevent jerky movement between the intake tube 3 and the intake tube mounting ring 5 and thus ensures no tilting of the intake tube 3 at the joint with the intake tube mounting ring 5. In addition, the annular projection 20 prevents the brazing material applied to a location C from entering the intake tube mounting ring 5 and reaching at the location B.

What is claimed is:

1. A method of securing intake tubes in an intake manifold comprising the steps of:

inserting one end of an intake tube into a corresponding intake tube mounting ring;

inserting a tubular jig into insert areas of the intake tube mounting ring and the intake tube through an inner side of the intake tube mounting ring, the jig including separate sections defined by parallel slits which extend to a predetermined length along the axis, and also including a plurality of spot projections and an annular projection, the spot projections being disposed on front portions of outer surfaces of the separate sections and spaced from each other along a circumferential direction of the separate sections, and the annular projection being positioned rearward of the spot projections;

inserting a pressing tool into the interior of a tubular body of the jig, the pressing tool comprising a bar with a diameter reduced towards its front end;

driving the pressing tool to advance relative to the insert areas using a pressing means so that the spot projections and the annular projection of the jig move radially and causes the outer side of the intake tube to press against the inner side of the intake tube mounting ring so as to have a configuration conforming to the configurations of the spot projections and the annular projection, thereby joining the intake tube to the intake tube mounting ring by its outward plastic deformation to conform to the configurations of the spot projections and the annular projection; and brazing the intake tube mounting ring and the intake tube by applying a brazing material therebetween, the brazing material being prevented by the annular projection from leaking toward the intake tube mounting ring.

2. A method of securing intake tubes in an intake manifold comprising the steps of:

inserting one end of an intake tube into a corresponding intake tube mounting ring;

inserting a tubular jig into insert areas of the intake tube mounting ring and the intake tube through an inner side of the intake tube mounting ring, the jig including separate sections defined by parallel slits which extend to a predetermined length along the axis, the diameter of the jig decreases toward a front end to the jig, the jig having a plurality of spot projections and an annular projection, the spot projections being disposed on front portions of outer surfaces of the separate sections and spaced from each other along a circumferential direction of the separate sections, and the annular projection being positioned rearward of the spot projections;

inserting a pressing tool into the interior of a tubular body of the jig, the pressing tool comprising a bar with a diameter reduced towards its front end;

driving the pressing tool to advance relative to the insert areas using a pressing means so that the spot projections and the annular projection of the jig move radially and cause the outer side of the intake tube to press against the inner side of the intake tube mounting ring so as to have a configuration conforming to the configurations of the spot projections and the annular projection, thereby joining the intake tube to the intake tube mounting ring by an outward plastic deformation to conform to the configurations of the spot projections and the annular projection; and brazing the intake tube mounting ring and the intake tube by applying a brazing material therebetween, the brazing material being prevented by the annular projection from leaking toward the intake tube mounting ring.

* * * * *